US006213494B1

(12) United States Patent
Liaw

(10) Patent No.: US 6,213,494 B1
(45) Date of Patent: Apr. 10, 2001

(54) FOLDABLE SERVING CART

(76) Inventor: Deng-Hae Liaw, 4F-3, No. 428, Chi Hsien 1st Road, Kaohsiung (TW)

( * ) Notice: Subject to any disclaimer, the term of this patent is extended or adjusted under 35 U.S.C. 154(b) by 0 days.

(21) Appl. No.: 09/427,720

(22) Filed: Oct. 27, 1999

(51) Int. Cl.[7] ..... B62B 3/02
(52) U.S. Cl. ..... 280/651; 280/47.35; 280/79.3
(58) Field of Search ..... 280/35, 38, 42, 280/639, 651, 47.34, 47.35, 79.11, 79.3; 108/166, 173

(56) References Cited

U.S. PATENT DOCUMENTS

| | | | | |
|---|---|---|---|---|
| 2,740,533 | * | 4/1956 | Mondineu | 108/173 |
| 2,938,632 | * | 5/1960 | Mondineu | 108/173 |
| 3,297,276 | * | 1/1967 | Skufca | 280/79.3 |
| 3,436,092 | * | 4/1969 | Werner | 280/651 |
| 4,793,497 | * | 12/1988 | Hall et al. | 280/79.3 |
| 5,131,547 | * | 7/1992 | Goldberg | 108/166 |
| 5,730,452 | * | 3/1998 | Fields | 280/79.3 |
| 5,806,864 | * | 9/1998 | Zielinski et al. | 280/79.3 |
| 5,816,419 | * | 10/1998 | Lamson | 280/79.3 |

FOREIGN PATENT DOCUMENTS

| | | | | |
|---|---|---|---|---|
| 652953 | * | 11/1962 | (CA) | 280/651 |
| 442037 | * | 1/1968 | (CH) | 280/47.35 |
| 352884 | * | 7/1931 | (GB) | 280/79.3 |
| 1165119 | * | 9/1969 | (GB) | 280/651 |
| 1342895 | * | 1/1974 | (GB) | 280/47.35 |

* cited by examiner

*Primary Examiner*—Frank Vanaman
(74) *Attorney, Agent, or Firm*—Rosenberg, Klein & Lee

(57) ABSTRACT

A foldable serving cart comprises a main support member, two second support members, support boards, locating parts and wheels. The main support member has an inverted "U" shape and has transverse rods across it. The second support members each has inverted "L" shape and is pivoted to the transverse rods from a top end and propping rods under the top end. The support boards are arranged on the top end and the propping rods of the second support members respectively. The support rod each has two separate boards and is pivoted to the main support member by means of the locating parts pivoted to the main support member. The two boards of each support board can be pivoted upwards and the second support members can be pivoted inwardly of the cart in order for the cart to be folded to a not-in-used position for saving space in storage.

2 Claims, 6 Drawing Sheets

FOLDABLE SERVING CART

BACKGROUND OF THE INVENTION

The present invention relates to a serving cart used for moving and serving foods and drinks.

Serving carts have been used for moving and serving foods and drinks for a long time, especially in restaurants.

Known serving carts usually have a table portion and wheels fitted to the lowest parts of the table portion. They cannot be folded to a more compact configuration when not being used.

Because such serving carts cannot be folded into a more compact configuration, they occupy much space in storage and transportation. Consequently, transportation costs are relatively high. Additionally, there are usually many carts used in restaurants, and it becomes a problem for the restaurants to store the unfoldable carts when they are not being used.

SUMMARY OF THE INVENTION

It is a main object of the present invention to provide a serving cart which can be folded to a more compact configuration when not being used.

It is another object of the present invention to provide a serving cart which can stand upright on the ground after it is folded such that it can be stored easily.

The serving cart of the present invention comprises a main support member, two second support members, support boards, locating parts and wheels. The main support member has an inverted "U" shape and has transverse rods across it. The second support members each include an inverted "L" shaped portion and are each pivoted to the transverse rods at its upper end and at propping rods extending therefrom at portions below the upper end. The support boards are respectively arranged over the upper ends and propping rods of the second support members. The support boards each include two separate board sections pivoted to the main support member by means of the locating parts. The two side board sections of each support board can be pivoted upwards with the second support members being pivoted laterally inward in order to fold the cart to a not-in-use configuration.

The cart further has connecting rods arranged in parallel to legs of the main support member. The locating parts are pivoted to the connecting rods such that the intermediate and the lower support boards are also pivoted upwards when the upper support board is pivoted upwards in folding the cart.

Consequently, the required space for storing of the serving cart is minimized, as is the cost for transportation of such carts.

BRIEF DESCRIPTION OF THE DRAWINGS

The present invention will be better understood by reference to the accompanying Drawings, wherein.

DETAILED DESCRIPTION OF THE PREFERRED EMBODIMENT

Figure 1:
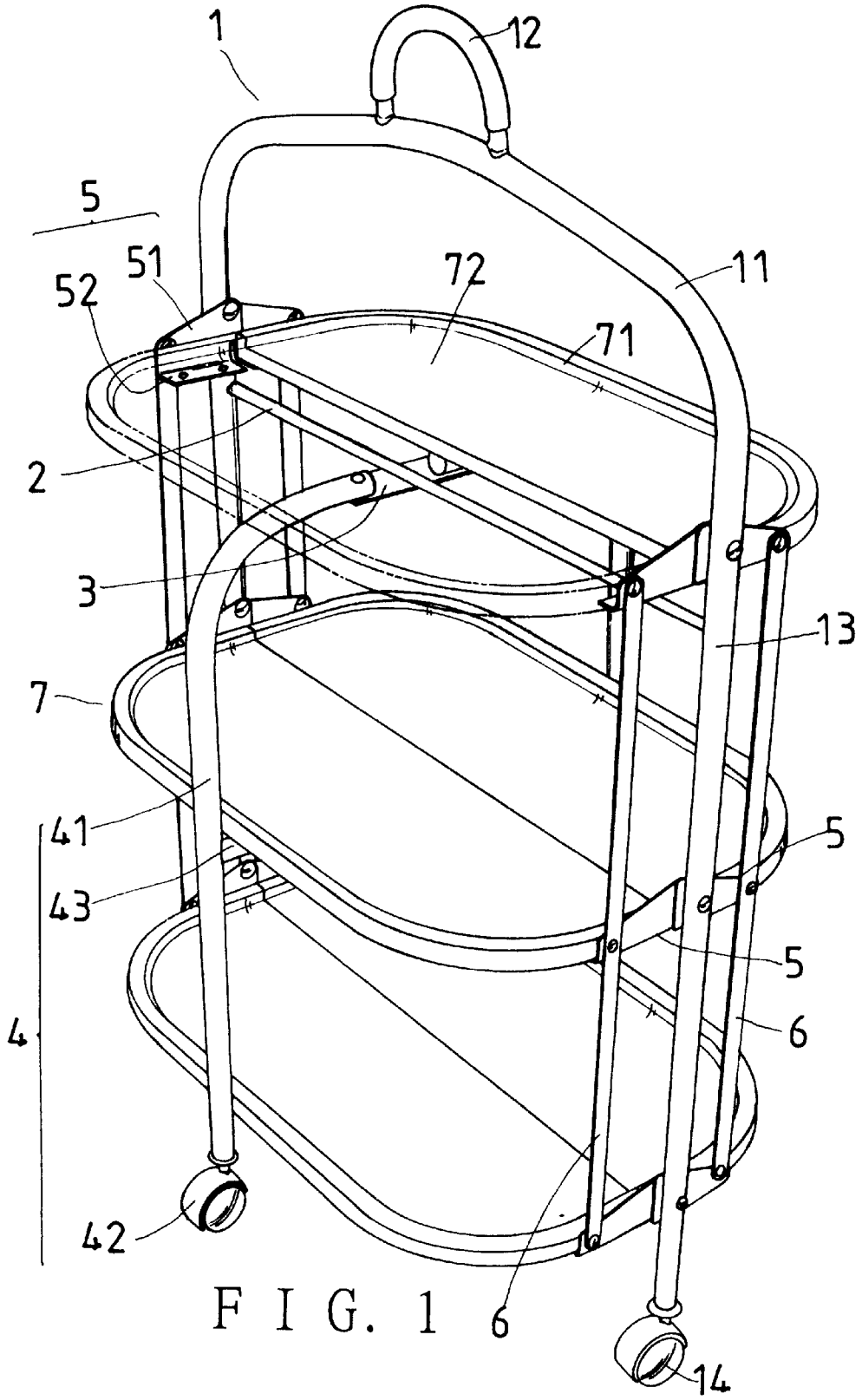
FIG. 1 is a perspective view of a foldable serving cart of the present invention.
Figure 2:
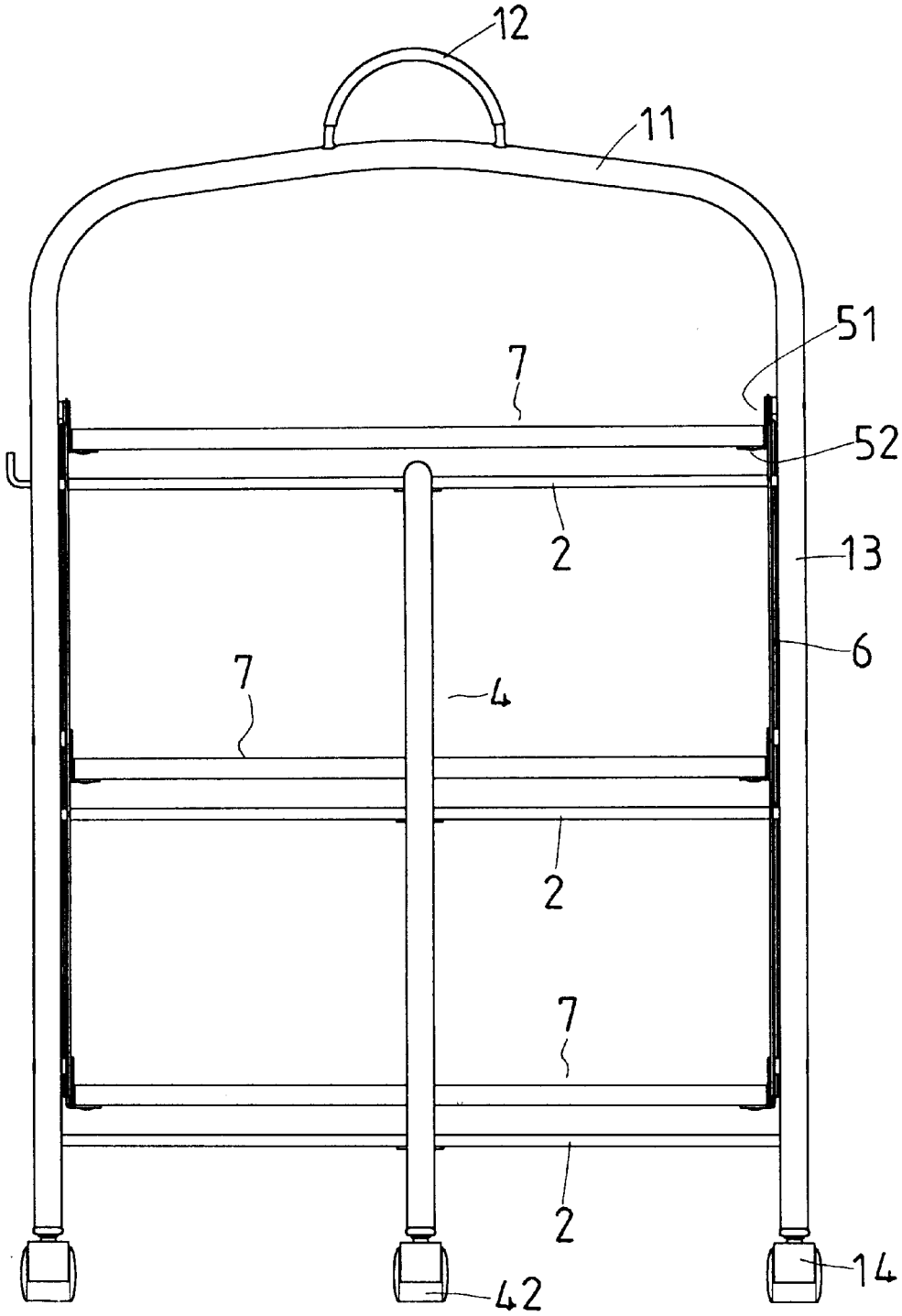
FIG. 2 is a front view of the foldable serving cart of the present invention.
Figure 3:
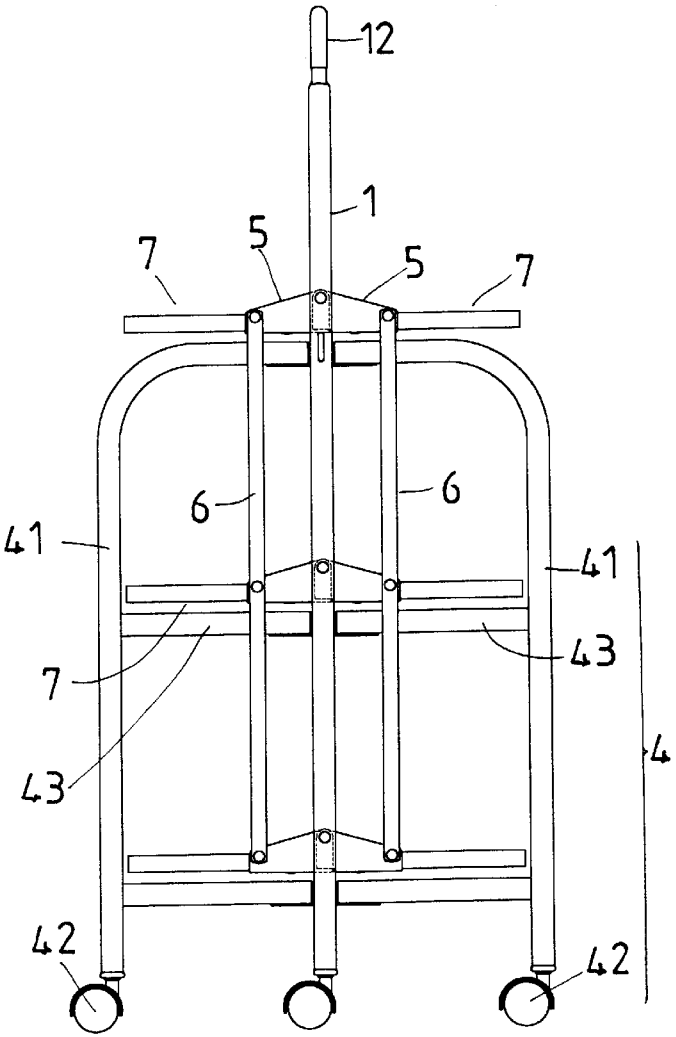
FIG. 3 is a side view of the foldable serving cart of the present invention.
Figure 4:
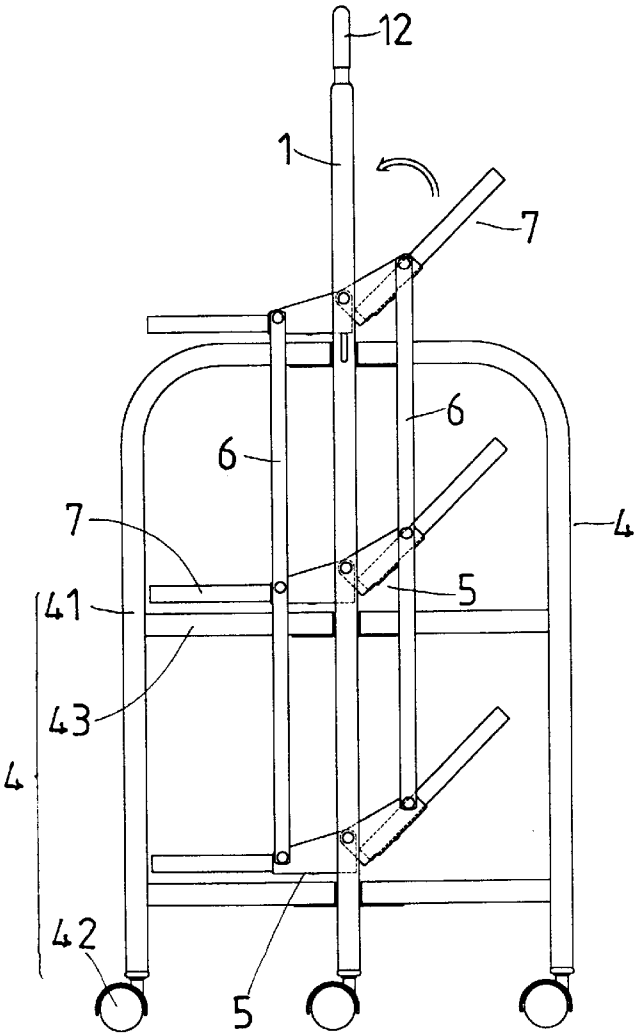
FIG. 4 is a side view of the folding serving cart in FIG. 3 with one side of the supporting flat boards being pivoted upwards.
Figure 7:
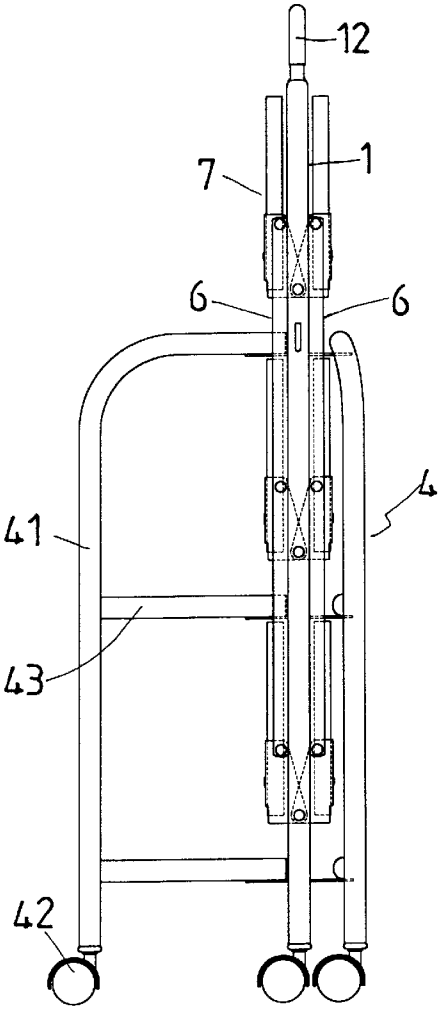
FIG. 7 is a side view of the foldable serving cart of the present invention with a first one of the second support members being pivoted inwardly.
Figure 5:
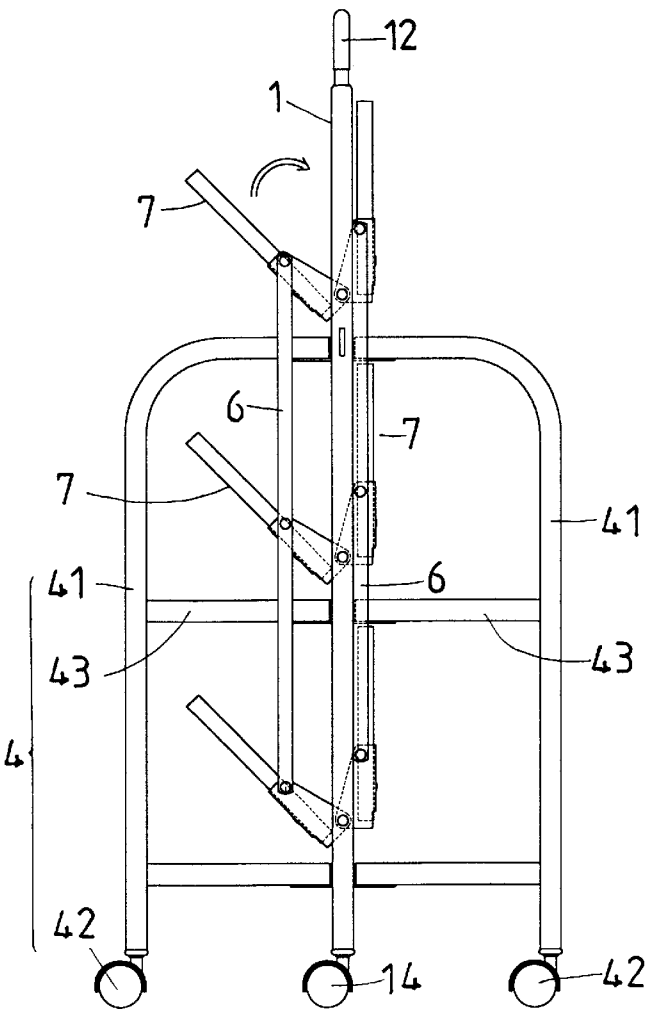
FIG. 5 is a side view of the foldable serving cart in FIG. 4 with one side of the supporting flat boards pivoted completely upwards and the other side being pivoted upwards.
Figure 8:
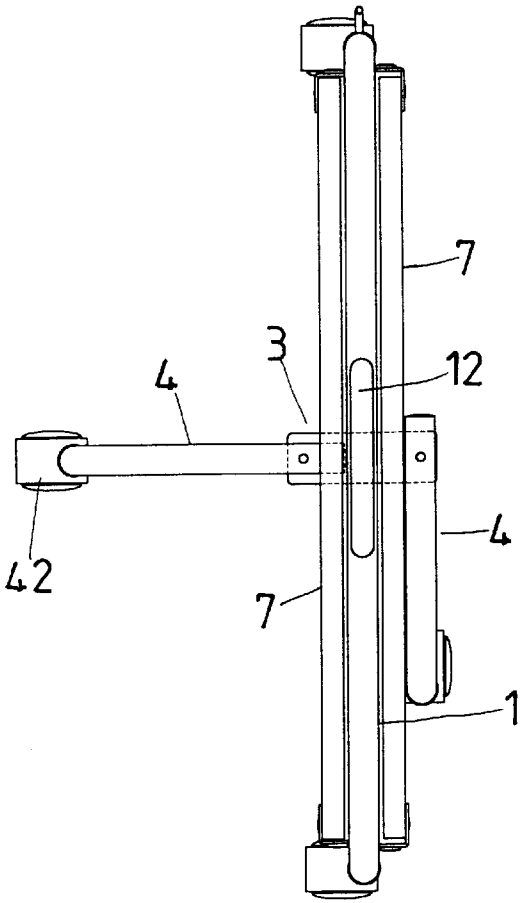
FIG. 8 is a top view of the foldable serving cart in FIG. 7 with one of the second support members being pivoted to a folded position.
Figure 6:
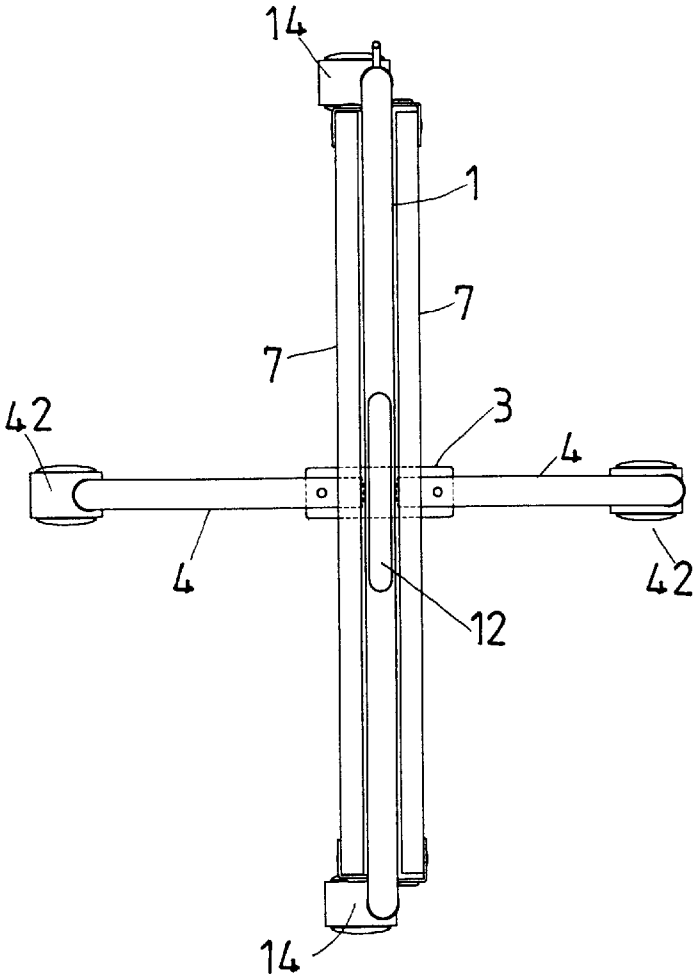
FIG. 6 is a top view of the foldable serving cart of the present invention with the two side board sections of the supporting flat boards pivoted to a folded position.

Referring to FIGS. 1–4, a foldable serving cart of the present invention comprises a main support member 1, several transverse rods 2, several connecting plates 3, two second support members 4, several locating parts 5, four connecting rods 6 and several supporting flat boards 7.

The main support member 1 has an inverted "U" shape. A handle 12 is fitted to an upper portion of the main support member 1. The lower ends of two legs 13 of the main support member 1 are each connected to a wheel 14.

The transverse rods 2 are connected to the legs 13 of the main support member 1 in a transverse manner. In the first embodiment of the present invention, there are three transverse rods 2 including an upper, an intermediate, and a lower transverse rod.

The connecting plates 3 are each coupled to a respective one of the transverse rods 2.

The second support members 4 each include an inverted "L" shaped portion. The upper end of each of the second support members 4 is pivoted to the upper one of the connecting plates 3. The second support members 4 each further include intermediate and lower propping rods 43 fixed to extend respectively from intermediate and lower parts thereof. The propping rods 43 are each pivoted to one of the connecting plates 3. The second support members 4 have wheels 42 connected to lower ends thereof.

The locating parts 5 are formed with a substantially "L" shaped sectional contour. The locating parts 5 each have a standing portion 51 and a transverse portion 52. Inner end portions of the standing portions 51 are pivoted to the two legs 13 of the main support member 1 at points above the upper, the intermediate, and the lower transverse rods, respectively.

The connecting rods 6 are parallel to the legs 13 of the main support member 1, and they are pivoted to outer end portions of the standing sides 51 of the locating parts 5.

The supporting flat boards 7 each include two separate board sections, and have a rim 71 and a holding recess 72 partially bounded by the rim 71. The supporting flat boards 7 are each arranged above a corresponding one of the transverse rods 2 and connected to the corresponding transverse portions 52 of the locating parts 5.

When the serving cart is unfolded to an in-use configuration, the supporting flat boards 7 are supported by the upper end portions and the propping rods 43 of the second support members 4, respectively. The second support members 4 are disposed such that its upper end portions and propping rods 43 are pivotal about an axis perpendicular to the transverse rods 2. Thus, foods and drinks can be held on the supporting flat boards 7.

Figure 10:
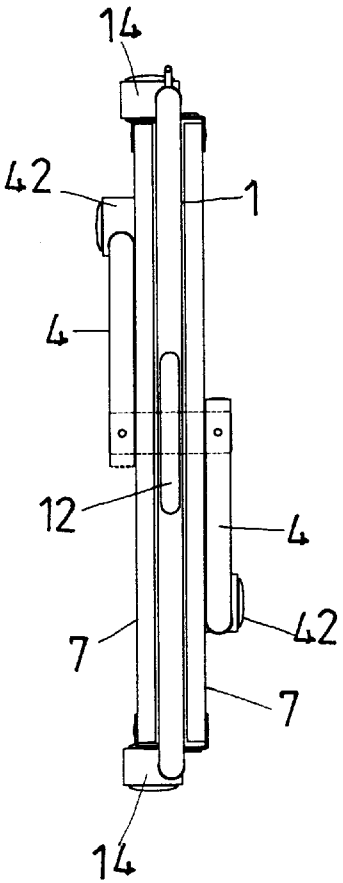
Figure 9:
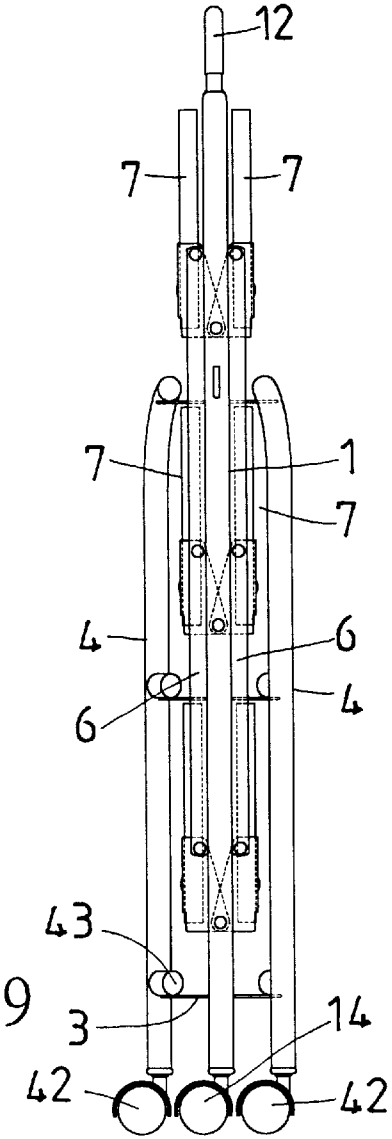
FIG. 9 is a side view of the foldable serving cart of the present invention in a folded not-in-use configuration; and, FIG. 10 is a top view of the foldable serving cart of the present invention in a folded not-in-use configuration.

To fold the serving cart to a folded not-in-use configuration, referring to FIGS. 5–10, first, the two separate board sections of the upper one of the flat boards 7 is pivoted upwards. The intermediate and lower flat boards 7 will be pivoted likewise because of the connecting rods 6. Secondly, one of the second support members 4 is pivoted inwardly in a first direction, and the other one of the second support members 4 is pivoted inwardly in a direction opposite the first direction. Thus, the serving cart is folded to the not-in-use configuration, as shown in FIG. 10. The folded cart can thus stand upright on the ground by means of the support members 1 and 4.

From the above description, it can be seen that the serving cart of the present invention has advantages as follows.

1. The serving cart can be folded to a smaller size so the space needed in transportation and storage is smaller than that of a conventional one, which cannot be folded.
2. The serving cart has a relatively uncomplicated structure and can be folded or extended very easily.
3. The folded cart can be stored very easily because it can stand upright.

What is claimed is:

1. A foldable serving cart comprising:

(a) a main support member having a substantially "U" shaped contour defined by a pair of longitudinally extended leg portions and an upper portion extending transversely therebetween;

(b) a plurality of transverse members extending between said leg portions of said main support member, each said transverse member having a connecting plate extending laterally therefrom;

(c) a pair of second support members pivotally coupled to said connecting plates, each said second support member having a substantially inverted "L" shaped section having an upper end portion, a lower portion, and an intermediate portion extending therebetween, each said second support member having at least one propping rod extending laterally from at least one of said intermediate and lower portions thereof, each said upper end portion and said propping rod being pivotally coupled to respective ones of said connecting plates;

(d) a plurality of wheels coupled respectively to said main and second support members;

(e) a plurality of locating parts coupled to said main support member, each said locating part having a standing side and a transverse side projecting transversely therefrom, said standing side having laterally opposed inner and outer end portions, said inner end portion being pivotally coupled to one said leg portion;

(f) a plurality of longitudinally extended connecting rods each coupled to said outer end portion of at least one said locating part standing side; and, (g) a plurality of supporting flat boards coupled to said transverse sides of said locating parts, said supporting flat boards being disposed respectively above said upper end portions and said propping rods of said second supporting members, each said supporting flat board including a pair of separately displaceable board sections;

whereby said supporting flat boards are displaceable pivotally in an upward direction, and said second support members are displaceable pivotally in an inward direction for collapsing said foldable serving cart to a folded configuration.

2. The foldable serving cart as recited in claim 1 wherein said main support member includes a handle coupled to said upper portion thereof.

* * * * *